US005587731A

United States Patent [19]

Yasunaga et al.

[11] Patent Number: 5,587,731

[45] Date of Patent: Dec. 24, 1996

[54] INK RETAINER

[75] Inventors: Kuniaki Yasunaga; Shigeru Ueno, both of Yokohama, Japan

[73] Assignee: Bridgestone Corporation, Tokyo, Japan

[21] Appl. No.: 199,653

[22] Filed: Feb. 22, 1994

[51] Int. Cl.[6] ..... B41J 2/175

[52] U.S. Cl. ..... 347/86; 524/112

[58] Field of Search ..... 524/112; 347/86, 347/87

[56] References Cited

U.S. PATENT DOCUMENTS 4,771,295 9/1988 Baker et al. ..... 347/87

5,182,579 6/1993 Haruta et al. ..... 347/87

5,358,984 10/1994 Hayes et al. ..... 524/112

*Primary Examiner*—Valerie A. Lund

*Attorney, Agent, or Firm*—Sughrue, Mion, Zinn, Macpeak & Seas

[57] ABSTRACT

An ink retainer is comprised of a flexible polyurethane foam which is prepared by reacting a polyether polyol with a polyisocyanate. The polyol includes at least 20% by weight based on the total weight of the polyol of a polymeric polyol having styrene and/or acrylonitrile grafted thereto. The foam contains at least 20 cells/inch. The foam is inserted in a container at a compression ratio by volume of 1/2 to 1/10 when the cell number is 20 to 50 cells/inch and 1/1 to 1/5 when the cell number is more than 50 cells/inch. The foam is resistant against attack from ink and ensures stable constant supply of ink.

4 Claims, 1 Drawing Sheet

FIGURE
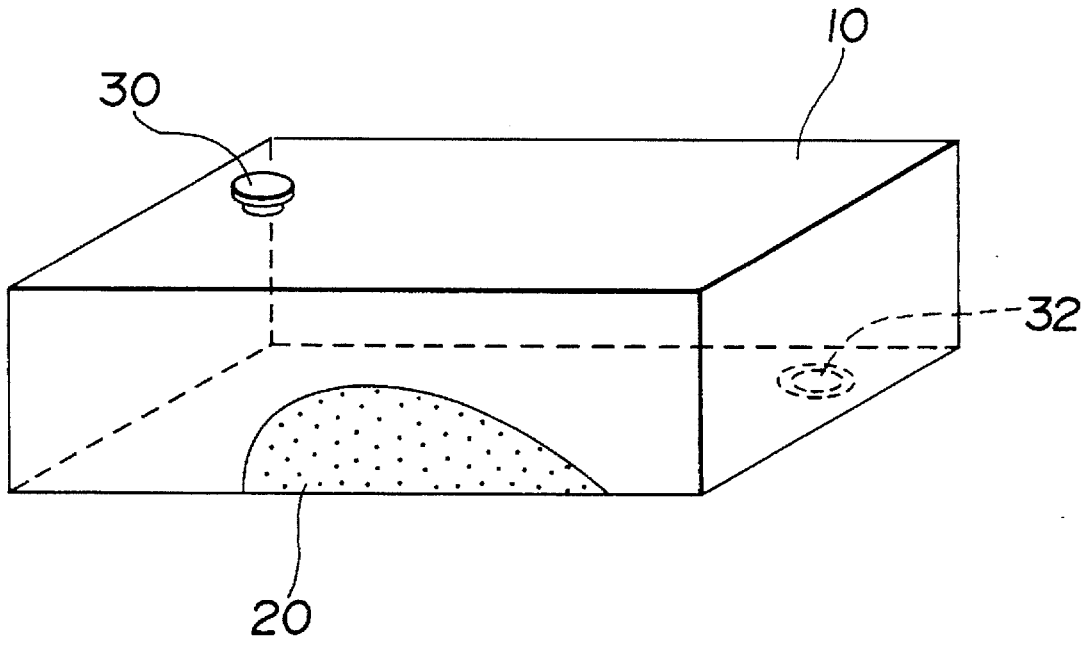

INK RETAINER

FIELD OF THE INVENTION

This invention relates to an ink retainer for storing and supplying ink to printing heads.

BACKGROUND OF THE INVENTION

Among business machines which have made a marked step forward, printers have changed from the wire dot and thermal transfer printing systems to the ink jet and laser beam printing systems. In-the ink jet printing system, an ink retainer is typically inserted in a container in order to retain the ink uniformly in the container.

Without such an ink retainer, it is difficult to feed ink from the container at a constant rate because the feed rate of ink can vary with the residual amount of ink in the container. In the printing system wherein the ink container moves together with the printing head, the ink always waves and sloshes in the container, hindering a constant ink supply and generating noise due to the collision of ink waves against the container wall.

For this reason, ink retainers are essentially needed in ink containers and are generally made of flexible polyurethane foams. Where an ester type polyurethane foam is used as an ink retainer, the foam itself can be deteriorated with a particular type of ink and such decomposition products can later be leached into the ink to alter the ink composition. For example, this results in ink having reduced surface tension so that letters printed therewith may be blurred. Usually polyurethane foam has cell membranes. If the foam is inserted in the ink container without removing the cell membranes, the cell membranes can adversely affect or alter the capacity to retain ink and the ability to release ink.

SUMMARY OF THE INVENTION

An object of the present invention is to provide an ink retainer suitable to be inserted in an ink container adapted for the ink jet printing system. Another object of the present invention is to provide a flexible polyurethane foam which is stable to retain and supply ink, free of attack by ink and thus best suited as an ink retainer.

According to the present invention, there is provided an ink retainer comprising a flexible polyurethane foam which is prepared by reacting a polyether polyol with a polyisocyanate preferably in the presence of a catalyst, a blowing agent, and a foam stabilizer. A polymeric polyol having styrene and/or acrylonitrile grafted thereto is used as one polyol component. The polymeric polyol is used in an amount of at least 20% by weight based on the weight of the entire polyol components. The foam contains at least 20 cells/inch.

In one preferred embodiment wherein the polyurethane foam contains 20 to 50 cells/inch, the foam is inserted in a container at a compression ratio by volume of 1/2 to 1/10. In another preferred embodiment wherein the polyurethane foam contains more than 50 cells/inch, the foam is inserted in a container at a compression ratio by volume of 1/1 to 1/5. Preferably the polyurethane foam after preparation is compressed by means of a hot press for permanent compression deformation.

BRIEF DESCRIPTION OF THE DRAWINGS

FIG. 1 is a partially cut-away perspective view of an example of an ink container.

DETAILED DESCRIPTION OF THE INVENTION

The polyether type polyurethane foam which constitutes an ink container according to the present invention is prepared by reacting a polyether polyol with a polyisocyanate in the presence of a catalyst, a blowing agent, a foam stabilizer and other aids.

Examples of the polyol used herein include those obtained by ring-opening addition polymerizing an alkylene oxide such as propylene oxide and ethylene oxide to a polyhydroxy compound such as glycerin, trimethylolpropane, pentaerythritol, sorbitol, sucrose, ethylene-diamine, and diethylenetriamine in the presence of alkali catalysts. Preferably the polyols have a hydroxyl value of up to 100, preferably 20 to 100, more preferably 25 to 60. More particularly, glycerin base polypropylene glycol having a molecular weight of 3,000 is a typical polyol.

According to the present invention, the polymeric polyol having styrene and/or acrylonitrile grafted thereto is used as one polyol component. The graft polyol used herein is obtained by graft polymerizing one or both of polystyrene and polyacrylonitrile to any of the above-mentioned polyols. One typical example of the graft polyol is V3940 commercially available from Dow Chemical Co. This polymeric polyol is used in an amount of at least 20% by weight, preferably 40 to 100% by weight based on the weight of the entire polyol components.

Examples of the polyisocyanate which can be used herein include aromatic and aliphatic polyisocyanates each containing at least two isocyanate groups in a molecule, and modified products thereof. Exemplary are tolylene diisocyanate (TDI), diphenylmethane diisocyanate, isophorone diisocyanate, and xylylene diisocyanate. The amount of polysocyanate used is preferably about 15 to 40 parts by weight per 100 parts by weight of the polyol component.

The catalyst and foam stabilizer may be selected from conventional ones. The catalysts include amine catalysts such as triethylene-diamine and tin catalysts such as stannous octoate. The stabilizers include silicone foam stabilizers. Their addition amount is preferably about 0.1 to 1.0 parts by weight of an amine catalyst, about 0 to 0.5 parts by weight of a tin catalyst, and about 0.1 to 2.0 parts by weight of a silicone foam stabilizer per 100 parts by weight of the polyol component.

In addition to the main components, water is added as a blowing agent, typically in an amount of about 0.9 to 4.5 parts by weight per 100 parts by weight of the polyol component. A foaming aid such as Freon and methylene chloride may be added, typically in an amount of up to about 3.0 parts per 100 parts by weight of the polyol component.

These components are concurrently admitted into a mixing head where the components are mixed to effect condensation and foaming reactions. In order to provide a relatively small cell diameter, the components are mixed in the mixing head under aeration.

The polyurethane preparing process is controlled to produce a polyurethane foam having at least 20 cells per inch. Normally the foam as prepared has membranes in its cells.

A preferred polyurethane foam is a three-dimensional reticulated foam having no cell membranes. The cell membranes are generally removed by immersing urethane foam in aqueous alkali solution or by an explosive method involving the step of admitting oxygen and hydrogen gases into urethane foam followed by ignition, with the explosive method being commonly employed.

A polyurethane foam having less than 20 cells/inch is undesirable. Even when such foam is compressed to increase the density, it exhibits less capillary action probably because of the originally large cell size and provides a reduced capacity to retain ink.

In one preferred embodiment wherein the polyurethane foam contains 20 to 50 cells/inch, the foam is inserted in a container at a compression ratio by volume of 1/2 to 1/10. In another preferred embodiment wherein the polyurethane foam contains more than 50 cells/inch, preferably more than 50 cells/inch to 100 cells/inch, the foam is inserted in a container at a compression ratio by volume of 1/1 to 1/5. Compression of the polyurethane foam may be done immediately before or at the same time as insertion into an ink container. Preferably the polyurethane foam after preparation is compressed by means of a hot press for permanent compression deformation and such a permanently deformed foam is inserted into a container.

Often the polyurethane foam a rectangular shape and compressed when it is inserted into a container. With a too low compression ratio, it would be difficult to compress the foam uniformly over its entire thickness. This results in less satisfactory capillary action and hence, a reduced capacity to retain ink. On the other hand, a too high compression ratio would reduce the capacity to release or supply ink.

One effective means for compressing the foam is hot press compression forming. The compression forming conditions include a temperature of about 150° to 210° C. and a time of about 10 to 100 minutes. Any desired compression ratio is achieved by controlling the hot pressing process as by inserting a spacer.

The reason why the polyurethane foam defined herein is an effective ink retainer is not well understood. We presume that the polymeric polyol component is effective for reducing swelling of the foam ink retainer with a solvent in ink and eventually preventing any organic matter in the foam ink retainer from being leached out.

The polyurethane foam ink retainer of the invention has the following advantages. Since a polyether polyol is used as one component for the preparation of polyurethane foam, the foam is not attacked or deteriorated by ink whether the ink is alkaline or acidic. Since a specific polymeric polyol is used as part or all of the polyether polyol component, the amount of decomposed products leached into the ink is minimized, eliminating the disadvantage of reduced ink surface tension. The polyurethane foam has relatively high hardness so that it can be inserted into a container while compressing it, without substantial deformation or wrinkling.

FIG. 1 shows as ink storage container comprising a container casing 10 and an ink retainer 20 placed therein for absorbing and retaining an aqueous liquid. The container casing may be formed in a box shape having an air vent 30 at the top and an ink exit port 32 at the bottom as shown in FIG. 1.

EXAMPLE

Examples of the present invention are given below by way of illustration and not by way of limitation.

Experiment 1

The polyether polyol used herein was a glycerin base polypropylene glycol having a molecular weight of 3,000. The styrene grafted polymeric polyol used was V3940 commercially available from Dow Chemical Co.

This experiment is to examine how foam varies with different polyols. Ink retainer sample No. 1 was a conventional polyurethane foam prepared from a polyester polyol and removed of-cell membranes by an explosive method. Sample No. 2 was a comparative polyurethane foam prepared from the polyether polyol. Sample No. 3 was a comparative polyurethane foam prepared from a mixture of 90% by weight of the polyether polyol and 10% by weight of the styrene grafted polymeric polyol. Sample No. 4 was a polyurethane foam prepared from a mixture of 50% by weight of the polyether polyol and 50% by weight of the styrene grafted polymeric polyol. Sample No. 5 was a polyurethane foam prepared from the styrene grafted polymeric polyol. All the foam samples were removed of cell membranes by the same explosive method. These foam samples had the properties reported in Table 1.

The foam samples were examined for ease of insertion and organic matter leaching.

Test 1

A foam block was compressed and inserted into an ink cartridge container to examine the friction between the foam and the container wall. More specifically, a rectangular foam block was compressed at a compression ratio of 25% by volume and forced into the container. It was determined how the foam block was deformed or turned over at the corner (deformation in mm). A smaller deformation indicates smoother insertion into the container.

Test 2

The leaching of organic matter from a foam block into the ink was examined. A foam block was immersed in ink at pH 10 for three weeks. The foam block was then dried to determine a weight loss, that is, the amount of organic mater leached into the ink. A less weight loss indicates smaller leaching and hence a better ink retainer.

TABLE 1

| Sample No. | 1 | 2 | 3 | 4 | 5 |
|---|---|---|---|---|---|
| Foam properties | | | | | |
| Density (kg/m$^3$) | 34.1 | 33.2 | 34.3 | 33.9 | 33.9 |
| Hardness (kgf) | 11.5 | 9.2 | 12.8 | 22.1 | 29.5 |
| Cell number (/inch) | 39 | 39 | 38 | 37 | 38 |
| Test 1: Deformation (mm) | 4 | 5 | 4 | 0 | 0 |
| Test 2: Weight loss (wt %) | 3.0 | 1.0 | 0.9 | 0.5 | 0.5 |

The conventional ink retainer of sample No. 1 was unsatisfactory in the tests. Even when a polyether polyol was used, in sample No. 2 which used no polymeric polyol and sample No. 3 which used a polymeric polyol, but in a smaller amount, the results of Test 1 were similar to that of the conventional ink retainer and the results of Test 2 were better than that of the conventional ink retainer, but still unsatisfactory. Sample Nos. 4 and 5 falling within the scope of the invention were satisfactory in both Tests 1 and 2.

Experiment 2

Foam samples were prepared by the same procedure as sample No. 4 except that the number of cells was changed. Sample Nos. 6, 7, 8, 9 and 10 had 10, 30, 40, 60, and 70 cells/inch, respectively. These foam samples were compressed at a compression ratio of 1/3, 1/5, 1/10, and 1/20 by volume. Note that the compression ratio of 1/1 means that the foam samples were used without compression. These foam samples were examined for ink retention capacity.

Test 3

The ink retention capacity was examined by inserting a foam sample into a rectangular container dimensioned 50 mm×30 mm×50 mm (height). The foam sample in the container was fully impregnated with pure water. Using a suction pump, water was discharged from the container at the bottom at a flow rate of 10 cc/min. The primary suction pressure of the pump was measured. The ink retention capacity was expressed by the measurement recorded immediately before the foam was emptied of water. A suction pressure in the range of −5 to −10 cm·$H_2O$ is acceptable for practical use. At a higher pressure, ink delivery is not smooth in actual ink containers. At a lower pressure, ink delivery is superfluous. The results are shown in Table 2.

TABLE 2

| Sample No. | 6 | 7 | 8 | 9 | 10 |
|---|---|---|---|---|---|
| Cell number | 10 | 30 | 40 | 60 | 70 |
| Compression ratio | | Suction pressure (cm.$H_2O$) | | | |
| 1/1 | | −0.3 | | | |
| 1/3 | | | | −7.5 | −8.2 |
| 1/5 | −0.5 | −7.5 | −8.5 | | |
| 1/10 | | | | | −20.2 |
| 1/20 | | −20.0 | | | |

Sample No. 6 shows that the ink retention capacity is low when the number of foam cells is small (coarse foam). Samples Nos. 7 and 8 show that a compression ratio of 1/2 to 1/10 is preferred when the number of foam cells ranges from about 20 to about 50. Sample Nos. 9 and 10 show that a compression ratio of 1/1 to 1/5 is preferred when the number of foam cells exceeds 50.

We have described a flexible polyurethane foam prepared using a specific polymeric polyol and having sufficient properties to serve as an ink retainer. The foam is resistant against attack from ink and ensures a stable constant supply of ink.

Although some preferred embodiments have been described, many modifications and variations may be made thereto in light of the above teachings. It is therefore to be understood that within the scope of the appended claims, the invention may be practiced otherwise than as specifically described.

We claim:

1. An ink retainer comprising a flexible polyurethane foam which is prepared by reacting a polyether polyol with a polyisocyanate, wherein said polyether polyol comprises a polymeric polyol, wherein at least one of styrene and acrylonitrile is grafted to said polymeric polyol, wherein said polymeric polyol is present in an amount of at least 20% by weight based on the total weight of said polyether polyol, wherein said polyurethane foam is a three-dimensional reticulated foam which contains at least 20 cells/inch and which has no cell membranes, and wherein said polyurethane foam absorbs and retains ink.

2. An ink retainer according to claim 1 wherein said polyurethane foam contains 20 to 50 cells/inch and is inserted in a container at a compression ratio by volume of 1/2 to 1/10.

3. An ink retainer according to claim 1 wherein said polyurethane foam contains more than 50 cells/inch and is inserted in a container at a compression ratio by volume of 1/1 to 1/5.

4. An ink retainer according to claim 1 wherein said polyurethane foam after preparation is compressed by means of a hot press for permanent compression deformation.

* * * * *